US008950932B2

(12) United States Patent
Breloff et al.

(10) Patent No.: US 8,950,932 B2
(45) Date of Patent: Feb. 10, 2015

(54) SYSTEMS AND METHODS FOR RECOVERING HYDROCARBONS

(71) Applicant: Zeta Global, Ltd., Niagara Falls (CA)

(72) Inventors: Steig Breloff, San Diego, CA (US); Lawrence Conaway, Lewiston, NY (US)

(73) Assignee: Zeta Global, Ltd. (CA)

( * ) Notice: Subject to any disclaimer, the term of this patent is extended or adjusted under 35 U.S.C. 154(b) by 6 days.

(21) Appl. No.: 13/782,073

(22) Filed: Mar. 1, 2013

(65) Prior Publication Data

US 2013/0245352 A1 Sep. 19, 2013

Related U.S. Application Data

(60) Provisional application No. 61/605,593, filed on Mar. 1, 2012.

(51) Int. Cl.
*B01F 13/00* (2006.01)
*C10G 1/04* (2006.01)

(52) U.S. Cl.
CPC ..... *C10G 1/045* (2013.01)
USPC ..... 366/341; 366/241; 210/759

(58) Field of Classification Search
None
See application file for complete search history.

(56) References Cited

U.S. PATENT DOCUMENTS

| | | | | |
|---|---|---|---|---|
| 5,797,701 | A | 8/1998 | Conaway | |
| 5,928,522 | A | 7/1999 | Conaway | |
| 6,096,227 | A | 8/2000 | Conaway | |
| 6,251,290 | B1 | 6/2001 | Conaway et al. | |
| 6,481,492 | B1 * | 11/2002 | Zhu et al. | 165/109.1 |
| 6,576,145 | B2 | 6/2003 | Conaway et al. | |
| 6,951,248 | B2 | 10/2005 | Conaway et al. | |
| 2004/0129646 | A1 | 7/2004 | Conaway et al. | |
| 2004/0222164 | A1 | 11/2004 | Conaway et al. | |
| 2006/0104157 | A1 | 5/2006 | Conaway et al. | |
| 2011/0268623 | A1 * | 11/2011 | Tallis | 422/202 |
| 2013/0158306 | A1 * | 6/2013 | Song et al. | 585/15 |
| 2013/0303817 | A1 * | 11/2013 | Shaik et al. | 585/504 |

* cited by examiner

*Primary Examiner* — Tam M Nguyen
(74) *Attorney, Agent, or Firm* — Schwegman Lundberg & Woessner, P.A.

(57) ABSTRACT

A method for recovering hydrocarbons from an aqueous hydrocarbonaceous slurry comprises pumping a mixture of the slurry and an oxidizing agent through a conduit, wherein the conduit comprises a plurality of stationary interior projections defining a non-linear path through the conduit, and thereby agitating the mixture to release the hydrocarbons from the slurry; and separating the hydrocarbons from the slurry.

14 Claims, 2 Drawing Sheets

SYSTEMS AND METHODS FOR RECOVERING HYDROCARBONS

CLAIM OF PRIORITY

This patent application claims the benefit of priority, under 35 U.S.C. §119(e), to U.S. Provisional Patent Application Ser. No. 61/605,593, entitled "SYSTEMS AND METHODS FOR RECOVERING HYDROCARBONS," filed on Mar. 1, 2012, which is hereby incorporated by reference herein in its entirety.

FIELD OF THE INVENTION

The present invention relates to hydrocarbons. More specifically, the present invention relates to systems and methods for recovering hydrocarbons from a hydrocarbonaceous slurry.

BACKGROUND OF THE INVENTION

Methods for treating hydrocarbon-containing materials using an oxidizing agent are known. For example, U.S. Pat. Nos. 5,797,701, 5,928,522, 6,096,227, and 6,251,290 describe methods that involve combining an aqueous slurry with an oxidizing agent, such as hydrogen peroxide, heating the resulting mixture to up to 80° C., and then agitating the mixture to oxidize the hydrocarbons and facilitate their separation from the slurry. U.S. Pat. No. 6,951,248 describes a method for separating oil from geological formations by application of an aqueous oxidant, such as hydrogen peroxide. However, such methods require extensive agitation times in order to sufficiently oxidize the hydrocarbons in the slurry.

U.S. Pat. No. 6,576,145 and U.S. Patent Application Publication Nos. 2004/0129646, 2004/0222164, and 2006/0104157 describe methods that involve combining an aqueous slurry with an oxidizing agent, such as hydrogen peroxide, heating the resulting mixture to up to 80° C., and then agitating the mixture in a linear oxidation vessel. The linear oxidation vessel is a long tube that is "P" shaped and comprises a plurality of rotary mixing devices disposed along the length of the tube to actively agitate the mixture as it flows through the tube. However, such methods require the input of energy in order to activate the rotary mixing devices and very long tubes are required in order to provide sufficient agitation to oxidize the hydrocarbons to the necessary extent. Additionally, the rotary mixers cause froth to develop in the mixture while it resides in the linear oxidation vessel.

Accordingly, there is a need for alternative technologies to overcome or mitigate at least some of the deficiencies of the prior art.

SUMMARY OF THE INVENTION

In accordance with an aspect, there is provided a method for recovering hydrocarbons from an aqueous hydrocarbonaceous slurry, the method comprising:

pumping a mixture of the slurry and an oxidizing agent through a conduit, wherein the conduit comprises a plurality of stationary interior projections defining a non-linear path through the conduit, and thereby agitating the mixture to release the hydrocarbons from the slurry; and separating the hydrocarbons from the slurry.

In an aspect, the method further comprises mixing the slurry and the oxidizing agent together in a reactor to form the mixture, prior to pumping the mixture through the conduit.

In an aspect, the method further comprises heating the mixture to a temperature of from about 50° C. to about 100° C. in the reactor.

In an aspect, the temperature is from about 80° C. to about 100° C.

In an aspect, the temperature is from about 85° C. to about 90° C.

In an aspect, the temperature is about 85° C.

In an aspect, the temperature does not exceed about 85° C.

In an aspect, the method further comprises treating the mixture with a pH-correcting agent.

In an aspect, the pH-correcting agent is selected from the group consisting of calcium oxide, calcium hydroxide, calcium carbonate, hydrochloric acid, carbon dioxide, and combinations thereof.

In an aspect, the method further comprises agitating and heating the hydrocarbonaceous slurry in a slurry hopper.

In an aspect, the hydrocarbonaceous slurry is heated to a temperature of from about 50° C. to about 90° C. in the slurry hopper.

In an aspect, the hydrocarbonaceous slurry is derived from a bituminous or kerogenous source.

In an aspect, the bituminous or kerogenous source is selected from the group consisting of tar, tar sands, oil shales, oil sandstones, lignite, roof shingles, asphalt, oil refinery waste, organic contaminated materials, industrial sludge, metal turnings coated in cutting-oil from metal machining and manufacture processes, and combinations thereof.

In an aspect, particles in the hydrocarbonaceous slurry have a diameter of less than about 2 mm.

In an aspect, the method further comprises mixing water with a hydrocarbonaceous feedstock to produce the hydrocarbonaceous slurry.

In an aspect, the water and feedstock are mixed in a weight proportion of water to feedstock solids of from about 2:1 to about 1:1.

In an aspect, the weight proportion of water to feedstock solids is about 2:1.

In an aspect, froth formation is suppressed in the conduit.

In an aspect, negligible froth is produced in the conduit.

In an aspect, the projections are baffles that project into the bore of the conduit from alternating walls of the conduit.

In an aspect, the oxidizing agent is selected from the group consisting of hydrogen peroxide, potassium permanganate, sodium peroxide, and combinations thereof.

In an aspect, the oxidizing agent is hydrogen peroxide.

In an aspect, the oxidizing agent is used in an amount of between about 0.1% to about 10% in water phase by weight.

In an aspect, the oxidizing agent is used in an amount of about 5% in water phase by weight.

In an aspect, the conduit is parallel to the ground or has a positive or negative slope with respect to the ground.

In an aspect, the conduit is parallel to the ground.

In an aspect, separating the hydrocarbons from the slurry comprises pumping the mixture into a separator to separate the oil phase from the aqueous and solid phases and to allow any large solids to separate gravitationally for discharge.

In an aspect, the separator is an American Petroleum Institute (API) separator.

In an aspect, the method further comprises pumping the slurry into a weir, for heating and agitating the slurry and thereby further separating the slurry into an aqueous layer, a layer comprising cleaned solids that are substantially freed of hydrocarbons, and an oil layer that forms a froth and contains the hydrocarbons.

In an aspect, the method further comprises collecting the froth and pumping the froth into an oil separator.

In an aspect, the aqueous layer is recycled for use in mixing with a subsequent feedstock batch for forming a subsequent batch of the aqueous hydrocarbonaceous slurry.

In an aspect, off-gas produced in the weir is recovered and used as a heat source in the method.

In an aspect, the method further comprises mixing the froth with a cutter stock to further separate the froth into a second aqueous phase, an organic phase comprising the hydrocarbons, and further solid tailings.

In an aspect, the second aqueous, the organic phase, and the further solid tailings are separated in a centrifuge.

In an aspect, the method further comprises distilling the cutter stock from the organic phase for recycling.

In an aspect, the method further comprises sending the organic phase to an oil refinery for further processing.

In an aspect, the method further comprises separating remaining solids from the hydrocarbonaceous slurry.

In an aspect, the solids comprise less than about 1% hydrocarbons.

In accordance with another aspect, there is provided a system for recovering hydrocarbons from an aqueous hydrocarbonaceous slurry, the system comprising:

a mixing zone for mixing the slurry with an oxidizing agent to form a mixture;

a conduit comprising a first end, a second end, and a plurality of stationary interior projections defining a non-linear path therebetween, the first end of said conduit operably connected to the mixing zone for receiving the mixture; and a separation zone, operably connected to the second end of said conduit, for separating the hydrocarbons from the aqueous slurry.

In an aspect, the mixing zone comprises a reactor for mixing the slurry and the oxidizing agent together to form the mixture.

In an aspect, the reactor is adapted to heat the mixture to a temperature of from about 50° C. to about 100° C.

In an aspect, the temperature is from about 80° C. to about 100° C.

In an aspect, the temperature is from about 85° C. to about 90° C.

In an aspect, the temperature is about 85° C.

In an aspect, the temperature does not exceed about 85° C.

In an aspect, the system further comprises a pH-correcting agent for treating the mixture.

In an aspect, the pH-correcting agent is selected from the group consisting of calcium oxide, calcium hydroxide, calcium carbonate, hydrochloric acid, carbon dioxide, and combinations thereof.

In an aspect, the mixing zone further comprises a slurry hopper for agitating and heating the hydrocarbonaceous slurry.

In an aspect, the slurry hopper is adapted to heat the hydrocarbonaceous slurry to a temperature of from about 50° C. to about 90° C.

In an aspect, the hydrocarbonaceous slurry is derived from a bituminous or kerogenous source.

In an aspect, the bituminous or kerogenous source is selected from the group consisting of tar, tar sands, oil shales, oil sandstones, lignite, roof shingles, asphalt, oil refinery waste, organic contaminated materials, industrial sludge, metal turnings coated in cutting-oil from metal machining and manufacture processes, and combinations thereof.

In an aspect, particles in the hydrocarbonaceous slurry have a diameter of less than about 2 mm.

In an aspect, water is mixed with a hydrocarbonaceous feedstock to produce the hydrocarbonaceous slurry.

In an aspect, water and feedstock are mixed in a weight proportion of water to feedstock solids of from about 2:1 to about 1:1.

In an aspect, the weight proportion of water to feedstock solids is about 2:1.

In an aspect, froth formation is suppressed in the conduit.

In an aspect, negligible froth is produced in the conduit.

In an aspect, the projections are baffles that project into the bore of the conduit from alternating walls of the conduit.

In an aspect, the oxidizing agent is selected from the group consisting of hydrogen peroxide, potassium permanganate, sodium peroxide, and combinations thereof.

In an aspect, the oxidizing agent is hydrogen peroxide.

In an aspect, the oxidizing agent is used in an amount of between about 0.1% to about 10% in water phase by weight.

In an aspect, the oxidizing agent is used in an amount of about 5% in water phase by weight.

In an aspect, the conduit is parallel to the ground or has a positive or negative slope with respect to the ground.

In an aspect, the conduit is parallel to the ground.

In an aspect, the separation zone comprises a separator to separate the oil phase from the aqueous and solid phases and to allow any large solids to separate gravitationally for discharge.

In an aspect, the separator is an American Petroleum Institute (API) separator.

In an aspect, the separation zone further comprises a weir, for heating and agitating the slurry and thereby further separating the slurry into an aqueous layer, a layer comprising cleaned solids that are substantially freed of hydrocarbons, and an oil layer that forms a froth and contains the hydrocarbons.

In an aspect, the system further comprises an oil separator for receiving and separating the froth.

In an aspect, the aqueous layer is recycled for use in mixing with a subsequent feedstock batch for forming a subsequent batch of the aqueous hydrocarbonaceous slurry.

In an aspect, off-gas produced in the weir is recovered and used as a heat source for the system.

In an aspect, the system further comprises a cutter stock for mixing with the froth to further separate the froth into a second aqueous phase, an organic phase comprising the hydrocarbons, and further solid tailings.

In an aspect, the separation zone further comprises a centrifuge, in which the second aqueous, the organic phase, and the further solid tailings are separated.

In an aspect, the cutter stock is distilled from the organic phase for recycling.

In an aspect, the organic phase is sent to an oil refinery for further processing.

In an aspect, any remaining solids are separated from the hydrocarbonaceous slurry.

In an aspect, the solids comprise less than about 1% hydrocarbons.

In accordance with another aspect, there is provided a method for recovering hydrocarbons from an aqueous hydrocarbonaceous slurry, the method comprising:

mixing the slurry with an oxidizing agent at a temperature of from about 80° C. to about 100° C. to form a mixture and thereby release the hydrocarbons from the slurry; and separating the hydrocarbons from the slurry.

In an aspect, the method further comprises pumping the mixture through a conduit, wherein the conduit comprises a plurality of stationary interior projections defining a non-linear path through the conduit, and thereby agitating the mixture to release the hydrocarbons from the slurry.

In an aspect, the method further comprises mixing the slurry and the oxidizing agent together in a reactor to form the mixture, prior to pumping the mixture through the conduit.

In an aspect, the mixture is heated in the reactor.

In an aspect, the temperature is from about 85° C. to about 90° C.

In an aspect, the temperature is about 85° C.

In an aspect, the temperature does not exceed about 85° C.

In an aspect, the method further comprises treating the mixture with a pH-correcting agent.

In an aspect, the pH-correcting agent is selected from the group consisting of calcium oxide, calcium hydroxide, calcium carbonate, hydrochloric acid, carbon dioxide, and combinations thereof.

In an aspect, the method further comprises agitating and heating the hydrocarbonaceous slurry in a slurry hopper.

In an aspect, the hydrocarbonaceous slurry is heated to a temperature of from about 50° C. to about 90° C. in the slurry hopper.

In an aspect, the hydrocarbonaceous slurry is derived from a bituminous or kerogenous source.

In an aspect, the bituminous or kerogenous source is selected from the group consisting of tar, tar sands, oil shales, oil sandstones, lignite, roof shingles, asphalt, oil refinery waste, organic contaminated materials, industrial sludge, metal turnings coated in cutting-oil from metal machining and manufacture processes, and combinations thereof.

In an aspect, particles in the hydrocarbonaceous slurry have a diameter of less than about 2 mm.

In an aspect, the method further comprises mixing water with a hydrocarbonaceous feedstock to produce the hydrocarbonaceous slurry.

In an aspect, the water and feedstock are mixed in a weight proportion of water to feedstock solids of from about 2:1 to about 1:1.

In an aspect, the weight proportion of water to feedstock solids is about 2:1.

In an aspect, froth formation is suppressed in the conduit.

In an aspect, negligible froth is produced in the conduit.

In an aspect, the projections are baffles that project into the bore of the conduit from alternating walls of the conduit.

In an aspect, the oxidizing agent is selected from the group consisting of hydrogen peroxide, potassium permanganate, sodium peroxide, and combinations thereof.

In an aspect, the oxidizing agent is hydrogen peroxide.

In an aspect, the oxidizing agent is used in an amount of between about 0.1% to about 10% in water phase by weight.

In an aspect, the oxidizing agent is used in an amount of about 5% in water phase by weight.

In an aspect, the conduit is parallel to the ground or has a positive or negative slope with respect to the ground.

In an aspect, the conduit is parallel to the ground.

In an aspect, separating the hydrocarbons from the slurry comprises pumping the mixture into a separator to separate the oil phase from the aqueous and solid phases and to allow any large solids to separate gravitationally for discharge.

In an aspect, the separator is an American Petroleum Institute (API) separator.

In an aspect, the method further comprises pumping the slurry into a weir, for heating and agitating the slurry and thereby further separating the slurry into an aqueous layer, a layer comprising cleaned solids that are substantially freed of hydrocarbons, and an oil layer that forms a froth and contains the hydrocarbons.

In an aspect, the method further comprises collecting the froth and pumping the froth into an oil separator.

In an aspect, the aqueous layer is recycled for use in mixing with a subsequent feedstock batch for forming a subsequent batch of the aqueous hydrocarbonaceous slurry.

In an aspect, off-gas produced in the weir is recovered and used as a heat source in the method.

In an aspect, the method further comprising mixing the froth with a cutter stock to further separate the froth into a second aqueous phase, an organic phase comprising the hydrocarbons, and further solid tailings.

In an aspect, the second aqueous, the organic phase, and the further solid tailings are separated in a centrifuge.

In an aspect, the method further comprises distilling the cutter stock from the organic phase for recycling.

In an aspect, the method further comprises sending the organic phase to an oil refinery for further processing.

In an aspect, the method further comprises separating remaining solids from the hydrocarbonaceous slurry.

In an aspect, the solids comprise less than about 1% hydrocarbons.

Other features and advantages of the present invention will become apparent from the following detailed description. It should be understood, however, that the detailed description and the specific examples while indicating embodiments of the invention are given by way of illustration only, since various changes and modifications within the spirit and scope of the invention will become apparent to those skilled in the art from said detailed description.

DESCRIPTION OF THE FIGURES

The present invention will be further understood from the following description with reference to the Figures, in which.

DETAILED DESCRIPTION OF THE INVENTION

A system and method for recovering hydrocarbons from an aqueous hydrocarbonaceous slurry is provided. The hydrocarbonaceous material may be derived from any bituminous or kerogenous source, such as tar, tar sands, oil shales, oil sandstones, lignite, roof shingles, asphalt, oil refinery waste, organic contaminated materials, industrial sludge, and metal turnings coated in cutting-oil from metal machining and manufacture processes, for example.

Figure 1:
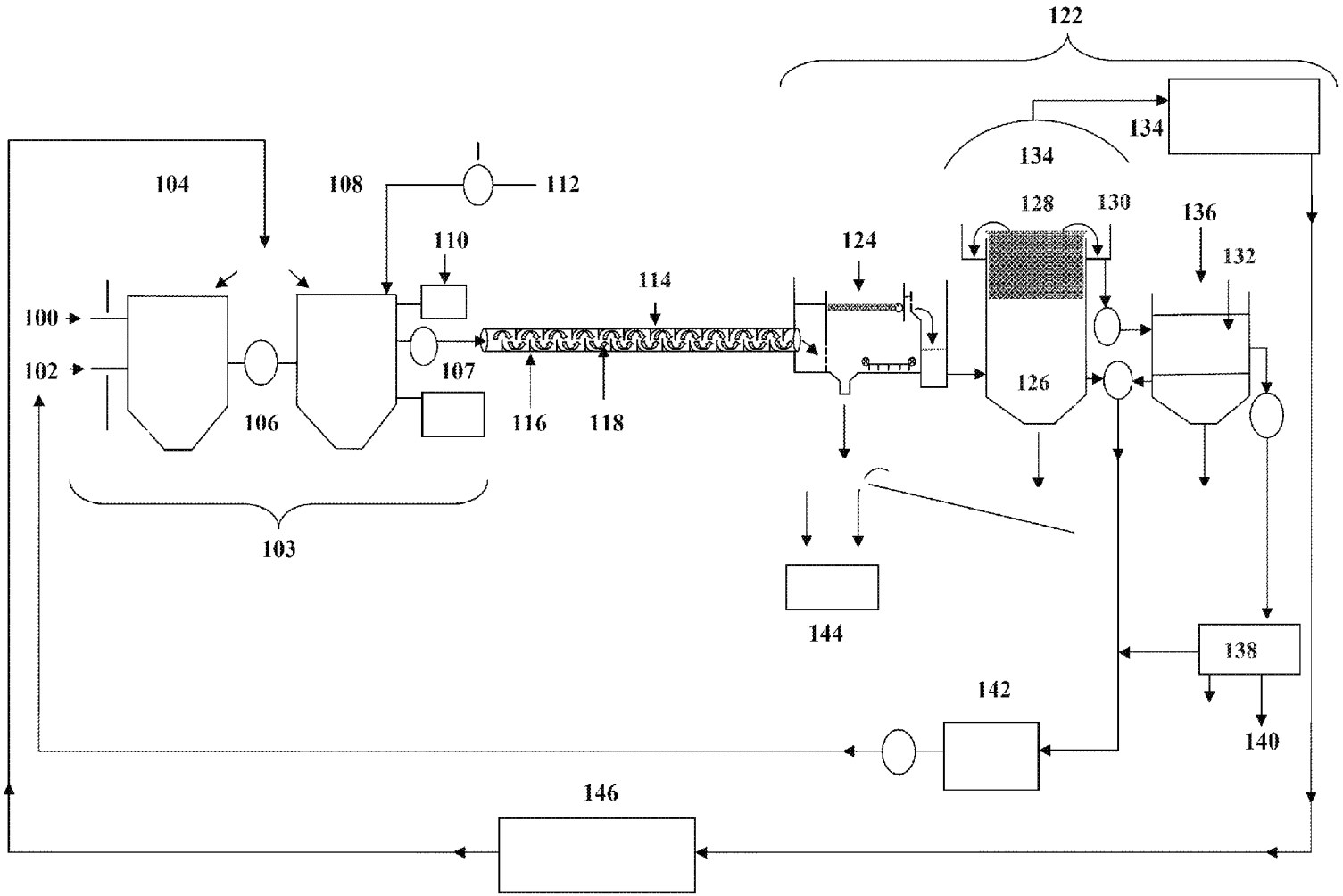
FIG. 1 shows a schematic view of system described herein.

Turning to FIG. 1, a hydrocarbonaceous material is mined, crushed, ground, comminuted, screened, or otherwise pretreated so as to eliminate large rocks and debris and to yield a feedstock 100 having a sand-like particle size of less than about 2 mm in diameter. Water 102 is mixed with the feedstock 100 in a mixing zone 103. The mixing zone 103 includes a slurry hopper 104 that forms a pumpable, aqueous, hydrocarbonaceous slurry 106 from the feedstock 100 and water 102. The slurry 106 has a weight percent proportion of water 102 to feedstock 100 of between about 2:1 and about 1:1, typically about 2:1.

The slurry 106 is conditioned by agitation and heating in the slurry hopper 104 to a temperature of between about 50° C. and about 90° C. to release free hydrocarbons, melt waxy hydrocarbon solids, reduce the viscosity of the batch, reduce the density of hydrocarbon fractions within the batch, and begin to break surface adhesion of hydrocarbon compounds bound to substrate surfaces. The free hydrocarbons thus released define a first hydrocarbon residue.

The slurry 106 is then pumped into a reactor 108, where it is heated to about 85° C. and is treated with a pH-correcting agent 110, such as calcium oxide, calcium hydroxide, calcium carbonate, hydrochloric acid, or carbon dioxide, for example, if necessary. The slurry 106 is then blended with an oxidizing agent 112, such as hydrogen peroxide, in an amount of between about 0.1% and about 10.0%, typically about 5%, in water phase by weight.

Although the reaction will proceed within the temperature range of between about 50° C. and about 100° C., temperature studies have shown that heating above 85° C. does not substantially increase hydrocarbon output volume yield. Without wishing to be restrained by theory, it is believed that the slurry 106, having been heated to about 85° C. and then mixed with the oxidizing agent 112 becoming mixture 107, undergoes an exothermic reaction that raises the reaction temperature to about 90° C. This exothermic reaction advantageously perpetuates the reaction between the slurry 106 and the oxidizing agent 112 within the mixture 107 without the additional input of heat from a secondary source. Additionally, the temperature of about 85° C. is advantageous because it provides for better release of viscous long-chain hydrocarbons from particle substrates. Heating to higher temperatures, such as 100° C., would also increase the water vapour component content in off-gas and would liberate more semi-volatile hydrocarbon components in the off-gas as well. Thus, the use of about 85° C. as the reaction temperature in the reactor 108 is surprisingly energy efficient and improves yield, without releasing excess water or hydrocarbon components in the off-gas.

Figure 2:
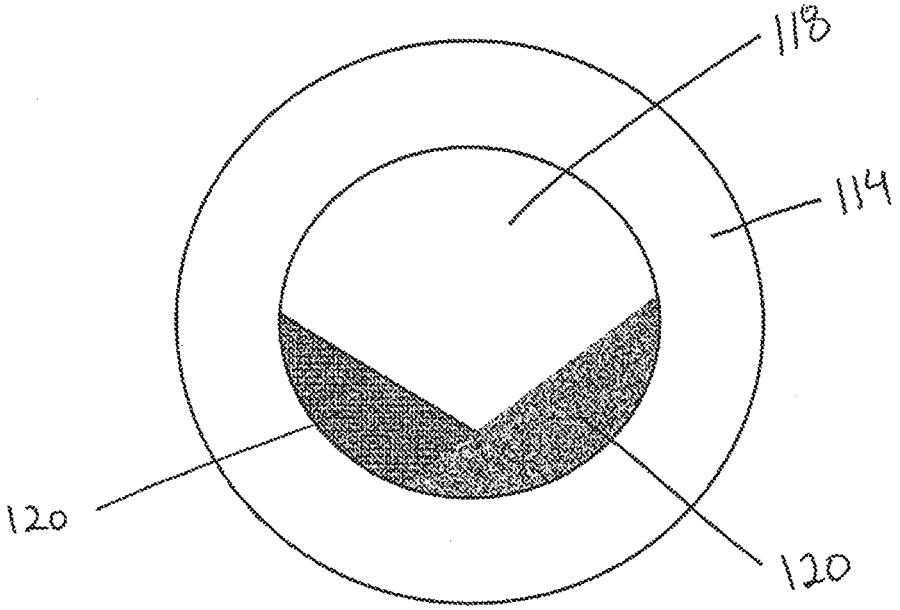
FIG. 2 shows a cross-sectional view of a conduit used in the system of FIG. 1.

The slurry 106 and oxidizing agent 112 mixture 107 is then pumped into a conduit 114 that includes a plurality of interior projections 116 that collectively define a non-linear path 118 through which the mixture 107 flows. As shown in FIG. 2, the projections 116 are formed as baffles 120 that project from alternating walls of the conduit 114. Advantageously, the projections 116 are stationary, meaning that they do not move or rotate. In this way, the mixture 107 is passively agitated simply by virtue of its flow through the non-linear path 118 within the conduit 114. This is beneficial because a reduced number of moving parts reduces chances of parts breaking or sticking and stopping production. Additionally, the technology is considered more environmentally friendly because no input of energy is required in order to cause agitation, since the agitation is passive rather than active.

Moreover, mixing in the conduit 114 described herein provides for improved mixing for a wide range of substrate particle sizes derived from the large variety of ore species, from micron-sized oil-shale particles to centimeter-sized gravel contained in asphalt, for example. The violent mixing caused by the projections 116 within the conduit 114 advantageously increases the number of times the substrate particles can be exposed to fresh oxidant, improving and it provides a method of suppressing formation of froth too early during the reaction of the slurry 106 with the oxidizing agent 112. Froth is produced when oxygen mixes with the slurry 106 and chemically attaches to the hydrocarbon molecules in the slurry 106. When this happens, the long-chain hydrocarbons cleave and float to the surface in a froth layer. It is important to prevent premature froth formation because the froth layer will trap solid fine particulates and prevent any further reaction between the particulates and the oxidizing agent 112 by effectively isolating the particulates in the froth. Advantageously, use of the conduit 114 described herein keeps the fines substantially suspended in the slurry 106 and oxidizing agent 112 mixture 107 for the duration of the reaction time, that is, the duration of the time that the mixture is spent in the conduit 114.

In the presence of heat and an oxidizing agent, the electrostatically bound hydrocarbons are released from the surface of particles within the slurry, especially very fine particles. The bound hydrocarbons thus released define a second hydrocarbon residue.

Without wishing to be bound by theory, it is believed that when the microscopic hydrocarbon-coated rock substrate particles within the feedstock 100 are suspended in a slurry 106, charged with the oxidizing agent 112, and transported through the non-linear path 118 within the conduit 114, the colloidal and interfacial reaction between the oxidizing agent and the particles may be explained at the microscopic level for particles that measure equal to or less than 10 μm in diameter by applying Formula I:

$$\xi = \frac{4\pi Q d}{D} \tag{I}$$

to calculate the ζ-potential, where Q=the charge per unit area; d=distance from the particle surface as the thickness of the Gegenion layer; and D=the dielectric constant of the layer.

Also without wishing to be bound by theory, it is believed that the heat and oxidizing agent also function to oxidize allyl and other hydrocarbon moieties to lighter petroleum fractions via Fenton's reaction. Hydrogen peroxide reacts with ubiquitous ferrous ions to produce a hydroxyl radical in an acidified aqueous medium, in accordance with Formula (II):

$$H_2O_2 + Fe^{2+} \rightarrow OH. + OH^- + Fe^{3+} \tag{II}$$

The resultant hydroxyl free radicals (OH.) are extremely powerful oxidizers that progressively react with organic compounds through a series of oxidation reactions. During the process, the oxidation reactions proceed according to Formula (III) by degrading the organic constituents (b) having long chain lengths (n carbon atoms) into a greater number of molecules (b+c) having less complex and shorter carbon chain lengths (n-a):

$$H_2O_2 + bC_nH_x \rightarrow H_2O + (b+c)C_{n-a}H_x + \frac{1}{2}O_2 \tag{III}$$

In an excess of oxidizing agent, all organic carbon may be converted to $CO_2$ in accordance with Formula (IV) (not balanced):

$$H_2O_2 + C_nH_x \rightarrow H_2O + nCO_2 \tag{IV}$$

However, in the process described herein, wherein reaction time, temperature, and the amount of oxidant may be precisely controlled by a programmable controller, Fenton's reaction is limited to breaking relatively few covalent bonds, sufficient only to reduce the average molecular weight of the very large molecular weight bituminous or kerogenic long-chain hydrocarbons that were the starting point, to those of the shorter-chain hydrocarbons found in the first and second residues chemically characterized as being similar to that of conventional crude oil produced from a well. Such shorter-chain hydrocarbons could then be processed in the same manner as crude oil is conventionally processed and can be sent to an oil refinery for distillation processing.

In one example of further processing, after mixture 107 is pumped through conduit 114, it reaches a separation zone 122, where the hydrocarbons are separated from the slurry 106 in the mixture 107. First, the mixture 107 is pumped into a separator 124, such as an American Petroleum Institute (API) separator, where the oil phase begins to separate from the aqueous and solid phases and any larger solids separate gravitationally and are discharged.

The mixture 107 then reaches a weir 126, which heats and agitates the mixture 107 and encourages the mixture 107 to further separate into: 1) an aqueous layer; 2) cleaned solids that settle to the bottom and are substantially freed of hydrocarbons; and 3) hydrocarbons that separate from the aqueous layer as they coalesce and float to the top of the weir to form an oil layer or froth 128, which is rich in first and second hydrocarbon residues. The froth 128 typically contains substantial amounts of entrained water and fines. For process efficiency, as shown in FIG. 1, generation of the next batch is permitted in reactor 108 while froth 128 is being further processed (semi-continuous, or moving batch process).

The froth 128 then spills over the weir 126 and into a collecting trough 130 surrounding the weir 126 and is then pumped into an oil separator 132. Water from the weir 126 is recycled back to the slurry hopper 104 as water 102. The weir 126 may optionally be configured so as to allow capture of the off-gas 134 produced during this stage. Optional vacuum recovery of off-gas 134 that develops would provide compressed gas to fuel a boiler and provide heat for the process system as this off-gas 134 is oxygenated and results in clean burning fuel.

To remove water and fines from the froth 128, the froth 128 containing oxidized and non-oxidized bitumen and/or kerogen is mixed, typically at a ratio of 1:1, with a "cutter stock" 136 (typically either diesel oil or naphtha), to dilute and solubilize the bitumen or kerogen, causing a further separation of the froth 128 into a second aqueous phase containing the fines and an organic phase containing the hydrocarbons. In some operations, this separation may be effected by discharging the blended froth 128 through a commercial centrifuge 138, from which the solid tailings from the aqueous phase may be landfilled directly. Typically, the hydrocarbon content of the combined first and second tailings, from the weir 126 and the oil separator 132, respectively, is less than about 1%, which meets the requirements for disposal in accordance with government regulations.

The reclaimed organic phase 140 may be subjected to distillation to remove and recover cutter stock 136 for recycling. The reclaimed organic phase 140, containing partially-oxidized bitumen and/or kerogen recovered by the subject process and free of the residual water and fine particulates which characterize hydrocarbon residues produced by the known art processes, now may be sent for further processing such as to an oil refinery.

It has been described above that the slurry 106 is pumped into reactor 108 and heated to about 85° C. It will be understood that a range of temperatures could be used, such as for about 50° C. to about 100° C., from about 80° C. to about 100° C., or from about 85° C. to about 90° C. However, a temperature of 85° C. is advantageous because it results in a more energy efficient process with improved yields, as has been described above. Thus, in an aspect, the temperature to which the slurry 106 is actively heated in the reactor 108 does not exceed about 85° C.

The oxidizing agent 112 has been described above as being hydrogen peroxide, however it will be understood that any oxidizing agent could be used, such as, for example, potassium permanganate or sodium peroxide. Hydrogen peroxide is advantageous because it ultimately decomposes into water and oxygen, leaving no elemental or mineral residue in the tailings.

The projections 116 have been described above as baffles 120 that project from alternating walls of the conduit 114. However, it will be understood that the baffles 120 could project from the walls of the conduit 114 in other ways and still provide a non-linear path 118 through the conduit 114. For example, while FIG. 2 shows the baffles 120 alternating in pairs along the cross-section of the conduit 114, extending from two different surfaces of the conduit 114, the baffles 120 could instead alternate in triplets and extend from three different surfaces of the conduit 114. Moreover, the shape, spacing, and/or angel of projection from the conduit 114 wall of the baffles 120 could be varied to increase or decrease non-linear flow as would be understood by a skilled person. Additionally, stationary projections 116 other than baffles 120 that collectively define a non-linear path 118 through which the mixture 107 of slurry 106 and oxidizing agent 112 flows are contemplated. For example, the projections could resemble a number of fingers that disrupt the linear flow of the mixture.

While the conduit 114 defines a non-linear path 118 through its bore, the conduit 114 itself may be linear or non-linear but is, in an aspect, linear. It will be understood that the length of the conduit 114 is determined by the required residence time of the mixture 107 of the oxidizing agent 112 and the slurry 106 to sufficiently oxidize the hydrocarbons in the mixture 107 and thereby strip them from the solid substrates to which they are attached. The conduit 114 is typically substantially parallel to the ground, such that the mixture 107 does not flow substantially on its own but must be pumped. However, it will be understood that the conduit 114 could be positioned at any angle to the ground in a positive or negative slope direction, as long as sufficient agitation of the mixture is provided to oxidize the hydrocarbons to the necessary degree.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Finally, terms of degree such as "substantially", "about" and "approximately" as used herein mean a reasonable amount of deviation of the modified term such that the end result is not significantly changed. These terms of degree should be construed as including a deviation of at least ±5% of the modified term if this deviation would not negate the meaning of the word it modifies.

The above disclosure generally describes the present invention. Although specific terms have been employed herein, such terms are intended in a descriptive sense and not for purposes of limitation.

All publications, patents and patent applications are herein incorporated by reference in their entirety to the same extent as if each individual publication, patent or patent application was specifically and individually indicated to be incorporated by reference in its entirety.

Although preferred embodiments of the invention have been described herein in detail, it will be understood by those skilled in the art that variations may be made thereto without departing from the spirit of the invention or the scope of the appended claims.

The invention claimed is:

1. A system for recovering hydrocarbons from an aqueous hydrocarbonaceous slurry, the system comprising:

a mixing zone for mixing the slurry with an oxidizing agent to form a mixture;

a conduit comprising a first end, a second end, and a plurality of stationary interior projections defining a non-linear path therebetween, the first end of said conduit operably connected to the mixing zone for receiving the mixture; and a separation zone, operably connected to the second end of said conduit, for separating the hydrocarbons from the aqueous slurry.

2. The system of claim 1, wherein the mixing zone comprises a reactor for mixing the slurry and the oxidizing agent together to form the mixture.

3. The system of claim 2, wherein the reactor is adapted to heat the mixture to a temperature of from about 50° C. to about 100° C.

4. The system of claim 3, wherein the temperature is about 85° C.

5. The system of claim 1, further comprising a pH-correcting agent for treating the mixture, wherein the pH-correcting agent is selected from the group consisting of calcium oxide, calcium hydroxide, calcium carbonate, hydrochloric acid, carbon dioxide, and combinations thereof.

6. The system of claim 1, wherein the mixing zone further comprises a slurry hopper for agitating and heating the hydrocarbonaceous slurry to a temperature of from about 50° C. to about 90° C.

7. The system of claim 1, wherein particles in the hydrocarbonaceous slurry have a diameter of less than about 2 mm.

8. The system of claim 1, wherein water is mixed with a hydrocarbonaceous feedstock to produce the hydrocarbonaceous slurry and wherein the water and feedstock are mixed in a weight proportion of water to feedstock solids of from about 2:1 to about 1:1.

9. The system of claim 1, wherein negligible froth is produced in the conduit.

10. The system of claim 1, wherein the projections are baffles that project into the bore of the conduit from alternating walls of the conduit.

11. The system of claim 1, wherein the oxidizing agent is selected from the group consisting of hydrogen peroxide, potassium permanganate, sodium peroxide, and combinations thereof.

12. The system of claim 1, wherein the oxidizing agent is used in an amount of between about 0.1% to about 10% in water phase by weight.

13. The system of claim 1, wherein the conduit is parallel to the ground.

14. The system of claim 1, wherein any remaining solids are separated from the hydrocarbonaceous slurry and wherein the solids comprise less than about 1% hydrocarbons.

* * * * *